US005678585A

United States Patent [19]

May

[11] Patent Number: 5,678,585

[45] Date of Patent: Oct. 21, 1997

[54] UMBRELLA

[76] Inventor: Anton May, Riedlingerstrasse 39, D-88422 Betzenweiler, Germany

[21] Appl. No.: 754,645

[22] Filed: Nov. 21, 1996

[30] Foreign Application Priority Data

Nov. 23, 1995 [DE] Germany ..... 195 43 601.6

[51] Int. Cl.[6] ..... A45B 11/00

[52] U.S. Cl. ..... 135/20.1; 135/21; 248/122.1; 248/125.7; 248/291.1; 403/101

[58] Field of Search ..... 135/19, 20.1, 20.3, 135/21, 15.1, 16; 403/98, 99–102; 248/122.1, 125.7, 176.1, 183.2, 286.1, 291.1

[56] References Cited

U.S. PATENT DOCUMENTS

| | | | |
|---|---|---|---|
| 3,521,651 | 7/1970 | Pearlstine | 135/20.1 |
| 3,765,434 | 10/1973 | Riggs | 135/20.1 |
| 3,923,047 | 12/1975 | Chant | 403/102 X |
| 4,111,217 | 9/1978 | Victor | 403/102 X |
| 4,485,931 | 12/1984 | Forster et al. | 403/100 X |
| 4,527,579 | 7/1985 | Knotter et al. | 403/100 X |
| 4,582,078 | 4/1986 | Ma | 135/20.1 X |
| 4,877,045 | 10/1989 | Lin | 135/20.3 |
| 5,011,176 | 4/1991 | Eppinette | 403/102 X |

FOREIGN PATENT DOCUMENTS

| | | | |
|---|---|---|---|
| 3229776 | 4/1983 | Germany | 135/21 |
| 528988 | 6/1955 | Italy . | |

*Primary Examiner*—Lanna Mai

*Attorney, Agent, or Firm*—Herbert Dubno; Andrew Wilford

[57] ABSTRACT

An umbrella has a foldable canopy, an elongated boom having an end, a joint at the end connected to the canopy and suspending the canopy from the boom end, an upright mast having an upper end, and a fitting having a lower part fixed in the upper mast end, an upper part slidably receiving the boom. A pivot interconnects the upper and lower parts for pivoting of the upper part on the lower part about a horizontal axis between a deployed position with the boom extending transversely of the mast and a storage position with the boom extending generally parallel to the mast. A slide is longitudinally displaceable on the mast between a lower position in which it frees the upper part for pivoting between its storage and deployed positions and an upper position in which it engages the upper part in both the storage and deployed positions and positively retains the upper part therein.

16 Claims, 8 Drawing Sheets

UMBRELLA

SPECIFICATION

1. Field of the Invention

The present invention relates to an umbrella. More particularly this invention concerns a large-format patio-type umbrella.

2. Background of the invention

A standard patio-type umbrella has a foldable canopy, an elongated boom having an end, a joint at the end connected to the canopy and suspending the canopy from the boom end, an upright mast having an upper end, and a fitting on the mast interconnecting the mast upper end and the boom. This fitting has an upper part slidably receiving the boom, a lower part fixed in the upper mast end, and a pivot interconnecting the upper and lower parts for pivoting about a horizontal axis between a deployed position with the boom extending transversely of the mast and a storage position with the boom extending generally parallel to the mast.

As described in German patent document 3,229,776 the upper fitting part has a toothed disk engaging another such toothed disk on the lower fitting part with a bolt engaged through these disks and defining the pivot axis therefore. A head of the bolt bears on one of the disks and a large nut on the other. Thus to adjust the angular position of the boom relative to the mast, the user loosens the nut until the parts can pivot freely relative to each other, positions the boom in the desired new position, and retightens the nut to set this new position. This is a relatively difficult operation requiring that the boom be held in one hand while the other hand is used to manipulate the adjustment nut. Holding up the boom while loosening and tightening the fitting can be too difficult for a small person, in view of the time it takes to unscrew the nut and screw it back down.

OBJECTS OF THE INVENTION

It is therefore an object of the present invention to provide an improved umbrella.

Another object is the provision of such an improved umbrella which overcomes the above-given disadvantages, that is which can be adjusted easily.

SUMMARY OF THE INVENTION

An umbrella has according to the invention a foldable canopy, an elongated boom having an end, a joint at the end connected to the canopy and suspending the canopy from the boom end, an upright mast having an upper end, and a fitting having a lower part fixed in the upper mast end, an upper part slidably receiving the boom. A pivot interconnects the upper and lower parts for pivoting of the upper part on the lower part about a horizontal axis between a deployed position with the boom extending transversely of the mast and a storage position with the boom extending generally parallel to the mast. A slide is longitudinally displaceable on the mast between a lower position in which it frees the upper part for pivoting between its storage and deployed positions and an upper position in which it engages the upper part in both the storage and deployed positions and positively retains the upper part therein.

Thus with this system all the user need do to change the umbrella between the storage and deployed positions is move the slide down and pivot the boom. It is not necessary to laboriously unscrew the nut holding the parts together while supporting the boom to store the umbrella, or laboriously hold up the boom while screwing in the nut to deploy it. The changeover can be done very quickly and easily. In fact the slide is moved in the same direction to free the upper fitting part both for movement into and out of its deployed position.

According to the invention a spring braced between the mast and the slide urges the slide into the upper position. The slide is tubular and surrounds the mast and lower fitting part. The upper fitting part has a lower portion fitting complementarily into the slide in the upper position thereof. In addition the parts are provided with respective abutment surfaces one of which is adjustable and that engage each other only in the deployed position. The upper part is formed with a downwardly and laterally open cutout in which the respective abutment surface is formed and the lower part is formed with an upwardly projecting portion in which the respective abutment surface is formed and which projects upward into the cutout in the deployed position. The portion of the lower part is provided with a screw extending generally perpendicular to a longitudinal axis of the mast and forming the respective abutment surface so that the screw can be driven in and out to move the respective abutment surface.

The upper part and the portion of the lower part in accordance with the invention have abutment surfaces that mutually engage each other only in the storage position. The upper part is formed with a notch into which an upper end of the slide fits in the upper position of the slide and storage position of the upper part. In addition the upper and lower parts have abutment surfaces that mutually engage each other only in the storage position. These abutment surfaces are to one side of a longitudinal axis of the mast.

According to the invention one of the parts has a pair of spaced cheeks extending toward the other part and the other part has a web fitted between the cheeks. The pivot is a pin extending through the cheeks and web along an axis substantially perpendicular to a longitudinal axis of the mast. The pin is seated in the cheeks and carries a bushing engaging the web. The webs are formed on the upper part and are formed with a notch into which an upper end of the slide fits in the upper position of the slide and storage position of the upper part. The one part is the upper part and the upper part is provided with a leaf spring projecting down into the lower part. The lower part is formed with a longitudinally extending and upwardly open passage receiving the leaf spring. The upper part has a block under which an end of the spring is secured.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
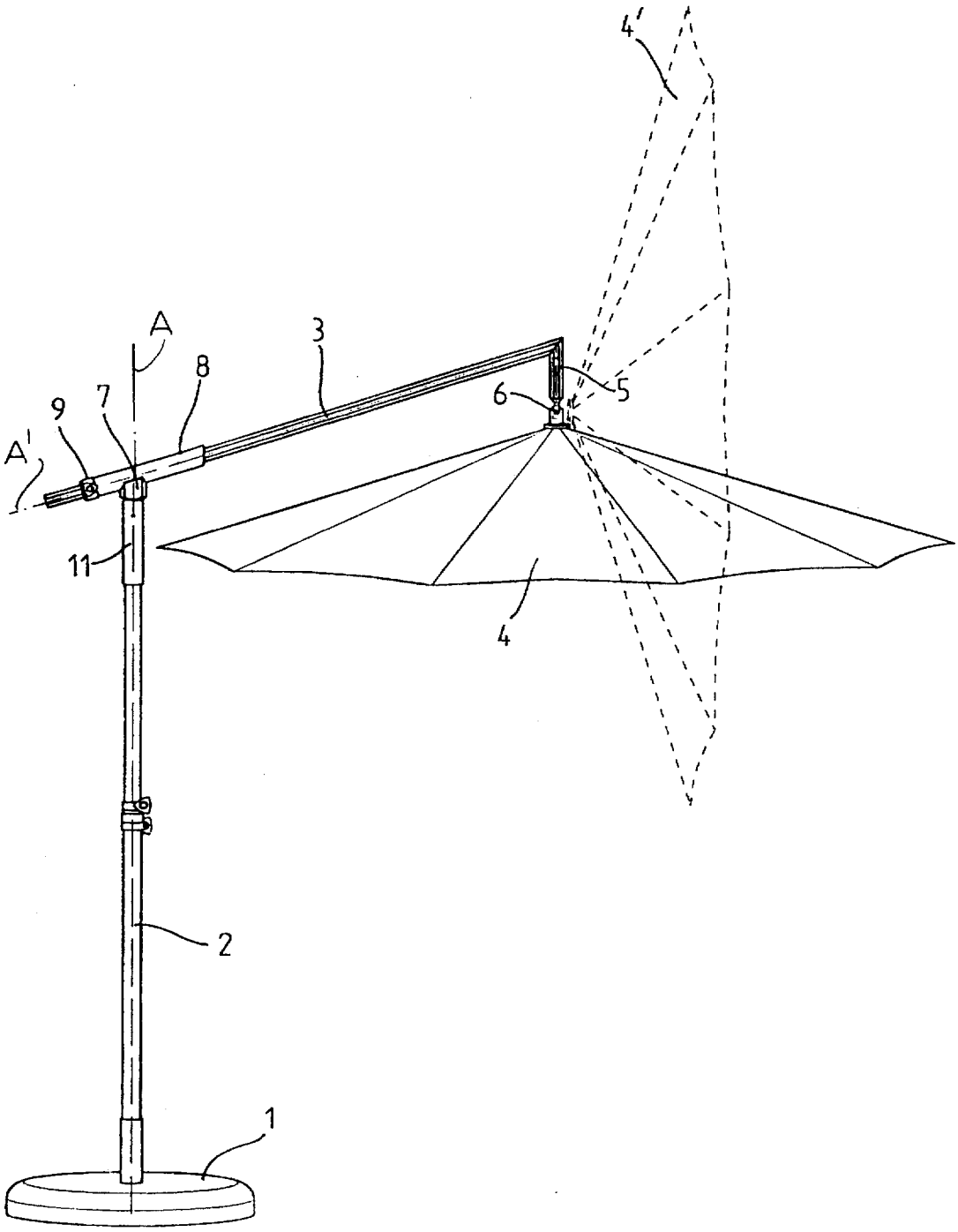
FIG. 1 is a small-scale side view of the umbrella according to the invention in the deployed position.
Figure 2:
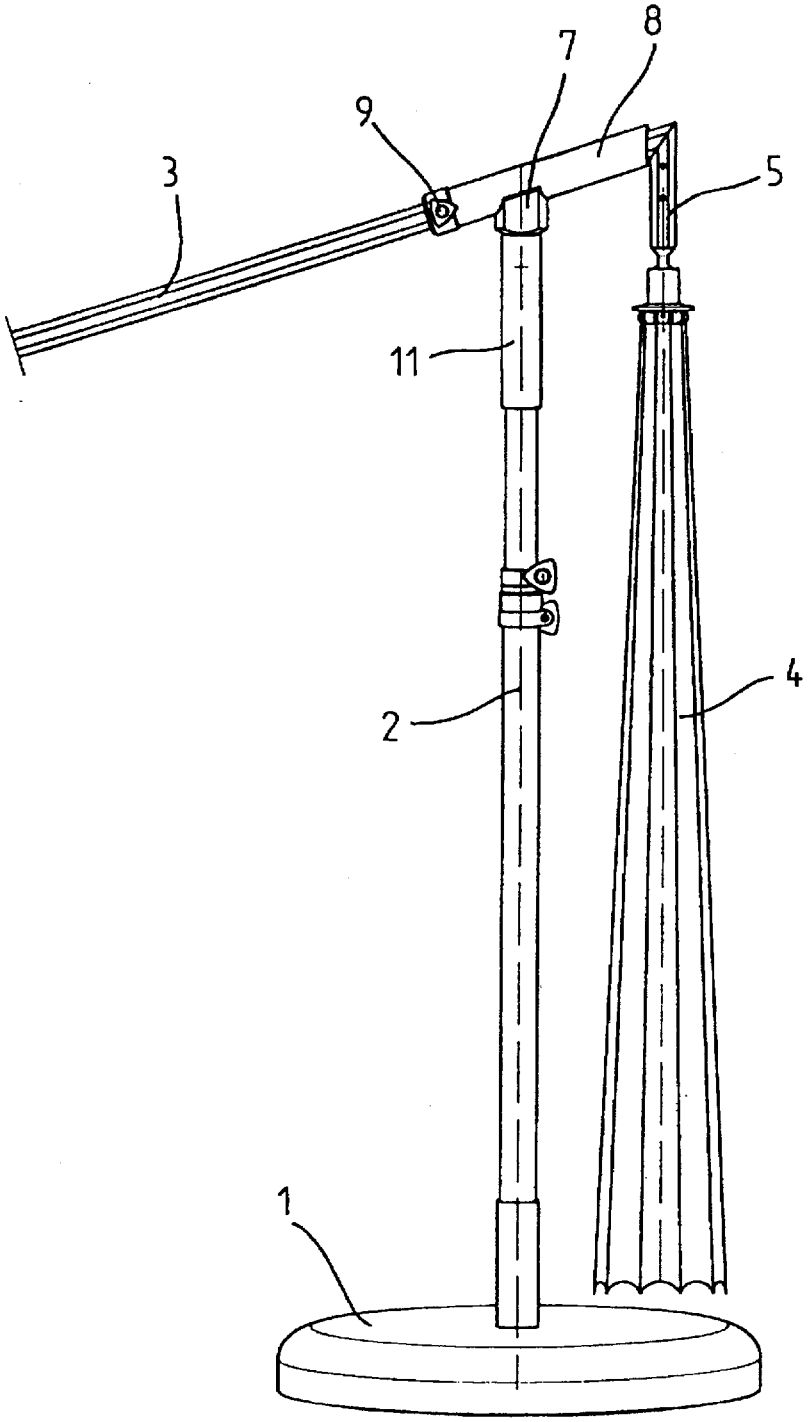
FIG. 2 is a view like FIG. 1 but showing the umbrella in an intermediate position.
Figure 3:
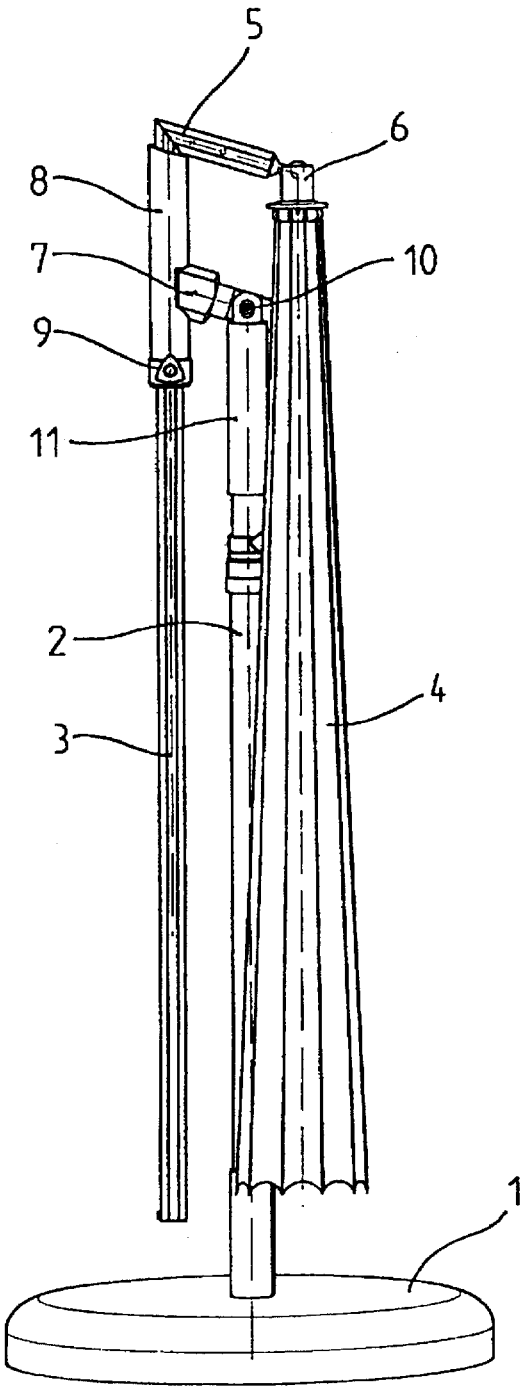
FIG. 3 is a view like FIG. 1 showing the umbrella in the stored position.

As seen in FIGS. 1 through 3 the umbrella according to this invention has a base 1 from which projects a vertically telescoping mast 2 centered on an axis A. A boom 3 secured to an upper end of the mast 2 by a fitting 7 extends along an axis A' transverse to the axis A and has an outer end provided with an L-shaped mount or fitting 5 connected via a lockable ball-and-socket swivel joint 6 to a standard collapsible umbrella canopy 4.

As better seen in FIGS. 4 through 9, the fitting 7 comprises a top tube 8 centered on the axis A' and provided with a clamping unit 9 so that the boom 3 can slide along the axis A' in the tube 8 and be arrested at any position therein. This fitting 7 has a cast aluminum upper part 16 screwed to the tube 8 and a cast aluminum lower part 18 fitted into the upper end of the mast 2 and fixed in place therein by crimps 19. The upper part 16 has a pair of downwardly projecting cheeks 23 flanking an upwardly projecting web 34 of the part 17. A screw 25 carrying a 5 bushing 26 extends along an axis 10 perpendicular to the axis A through holes 24 in the cheeks 23 and web 34 so that the two parts 16 and 17 can pivot between the deployed position of FIG. 4 and the storage position of FIGS. 7 and 8.

The boom 3 can therefore, in the deployed position of the fitting 1, slide between the advanced position of FIG. 1 in which the canopy 4 can be opened or even locked at the swivel 6 in an upright position as shown at 4', and the retracted position of FIG. 2 in which the canopy 4 must be collapsed and in which the canopy 4 hangs immediately adjacent the mast 2. When in the FIG. 2 retracted position the fitting 7 can be hinged about the axis 10 into the storage position of FIG. 3 to orient the axis A' parallel to the axis A, with the boom 3 immediately adjacent the mast 2. In this FIG. 3 position the entire umbrella takes up very little floor space.

Figure 4:
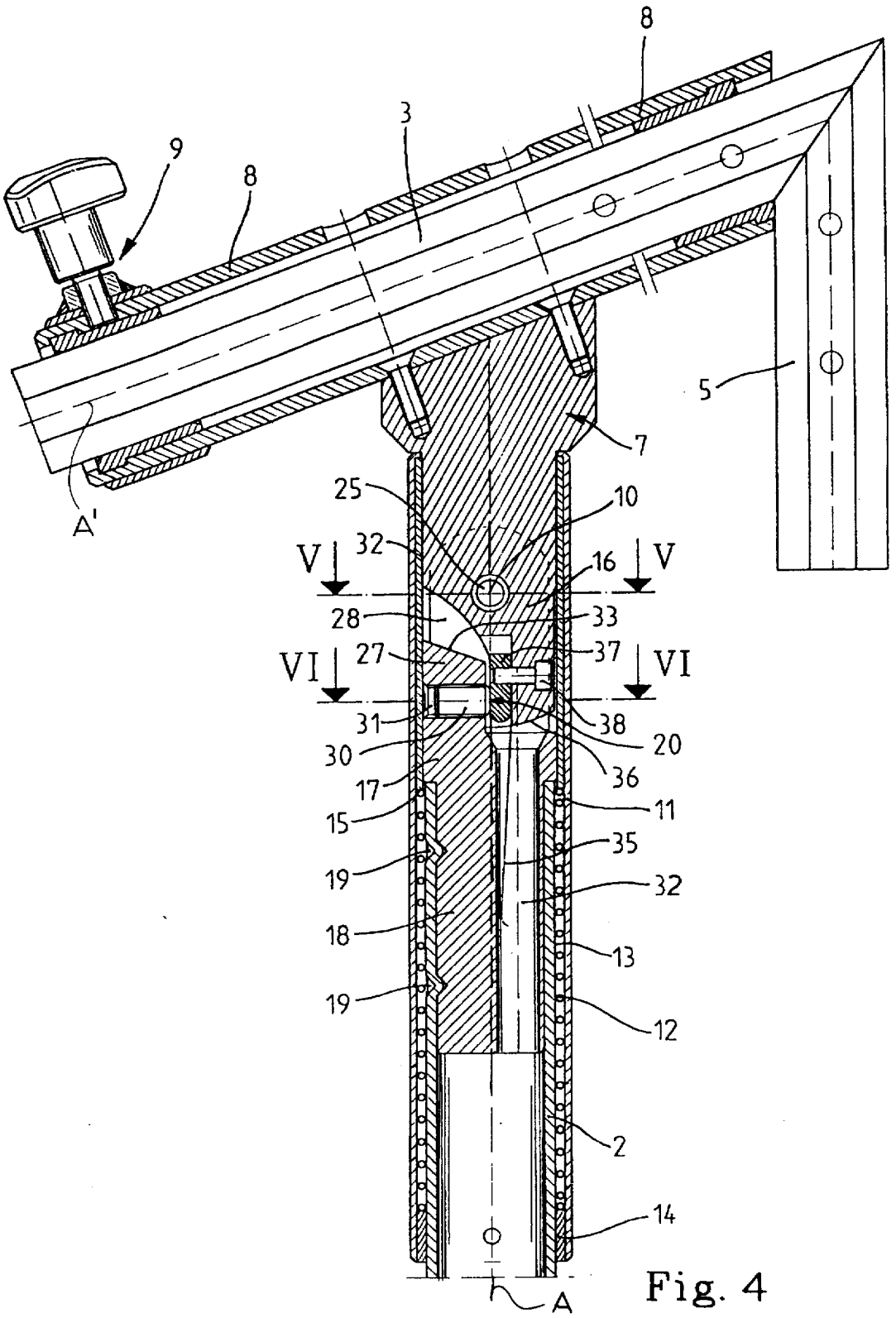
FIG. 4 is a large-scale vertical section through the fitting of the umbrella in the FIG. 3 intermediate position.
Figure 5:
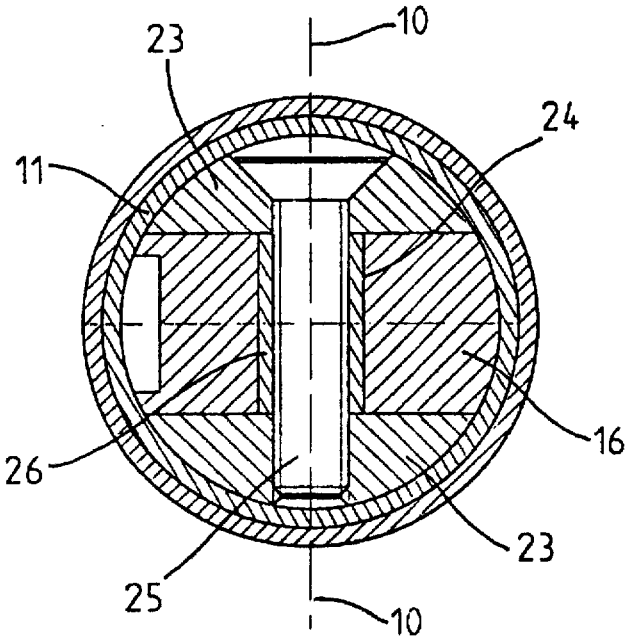
FIGS. 5 and 6 are horizontal cross sections taken along respective lines V—V and VI—VI of FIG. 4.
Figure 6:
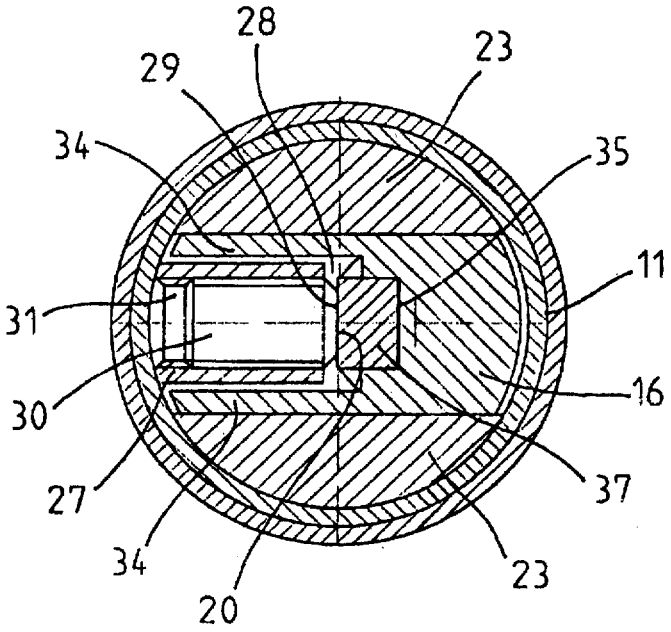

A retaining latch constituted as a tubular slide 11 surrounds the upper end of the mast 2. A helical compression spring 12 contained in a space 13 between the mast 2 and slide 11 has a lower end braced on a ring 14 fixed on the mast 2 and an upper end fixed on a shoulder 15 formed in the sleeve slide 11 so as to urge it upward parallel to the axis A. When the tubular slide 11 is in its upper position and the fitting 7 is in the deployed position as shown in FIG. 4, the slide 11 closely surround a cylindrical outer surface 22 of the upper part 16 so that the parts 16 and 17 are coaxial.

Figure 8:
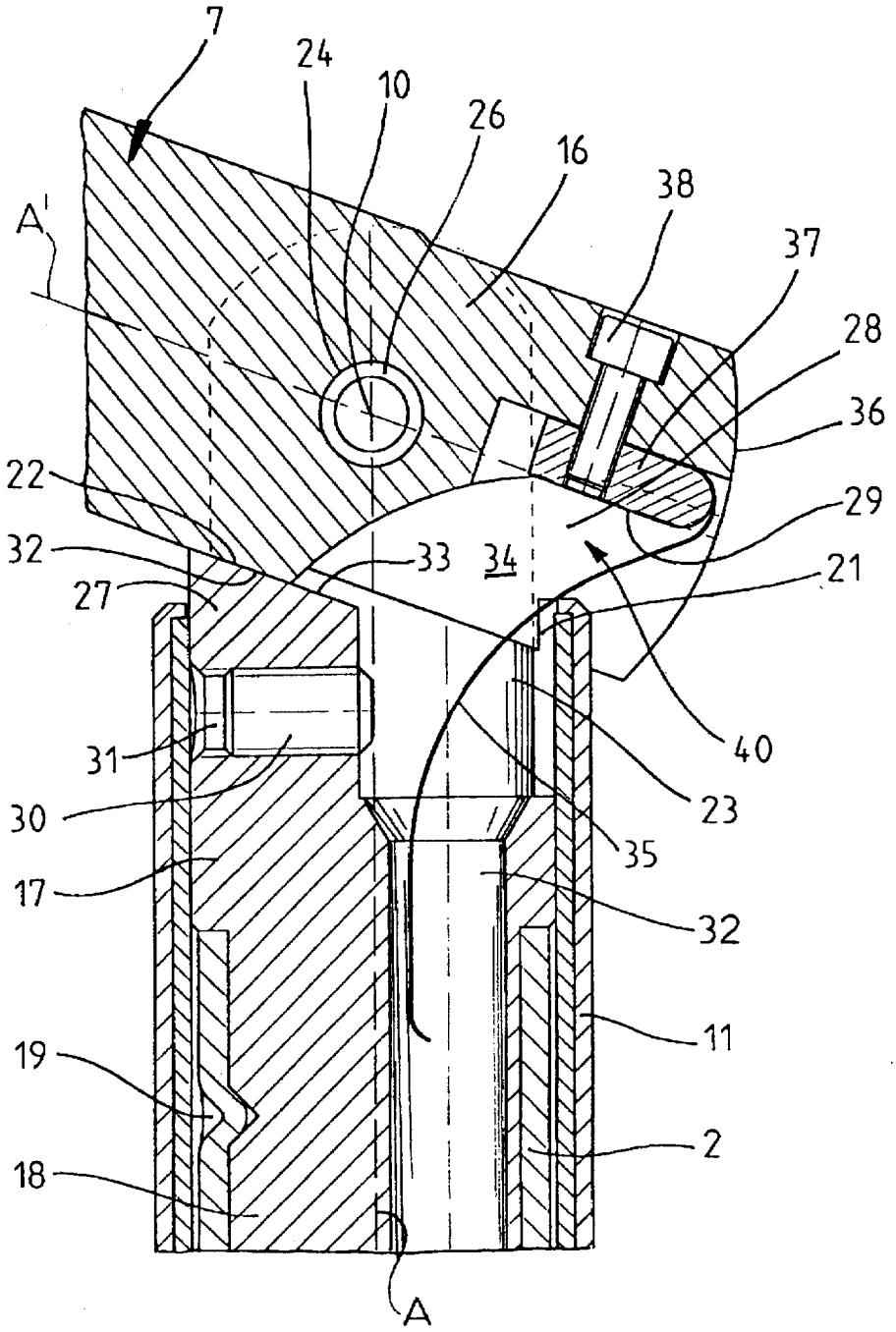
FIG. 8 is a view like FIG. 7 but with the slide advanced.
Figure 9:
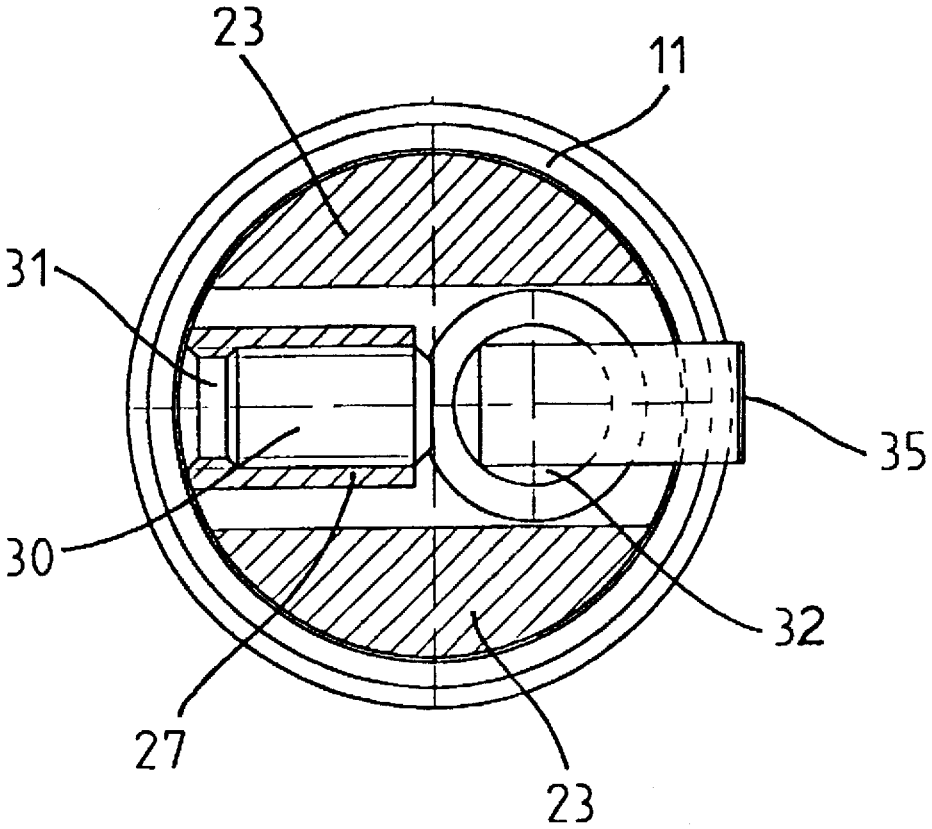
FIG. 9 is a horizontal cross section taken along line IX—IX of FIG. 7.

The fitting part 16 is formed with a cutout 28 that fits an upper portion 27 of the part 17 so these parts 16 and 17 overlap axially in the deployed position. In the storage position an upper surface 33 of the portion 27 of the part 16 lies flatly against the outer surface 22 of the part 17. In addition this part 15 is formed with an arcuate downwardly open retaining notch or groove 21 into which the upper end of the slide 11 can engage as shown in FIG. 8 to positively retain the fitting 7 in the storage position. In the deployed position an abutment system 20 constituted by a surface 29 of the fitting part 16 engages a steel abutment screw 30 threaded into a bore 31 formed n the part 17 and extending radially of the axis A. The screw 30 can be driven in or out to ensure that the parts 16 and 17 are perfectly coaxial in the deployed position.

Figure 7:
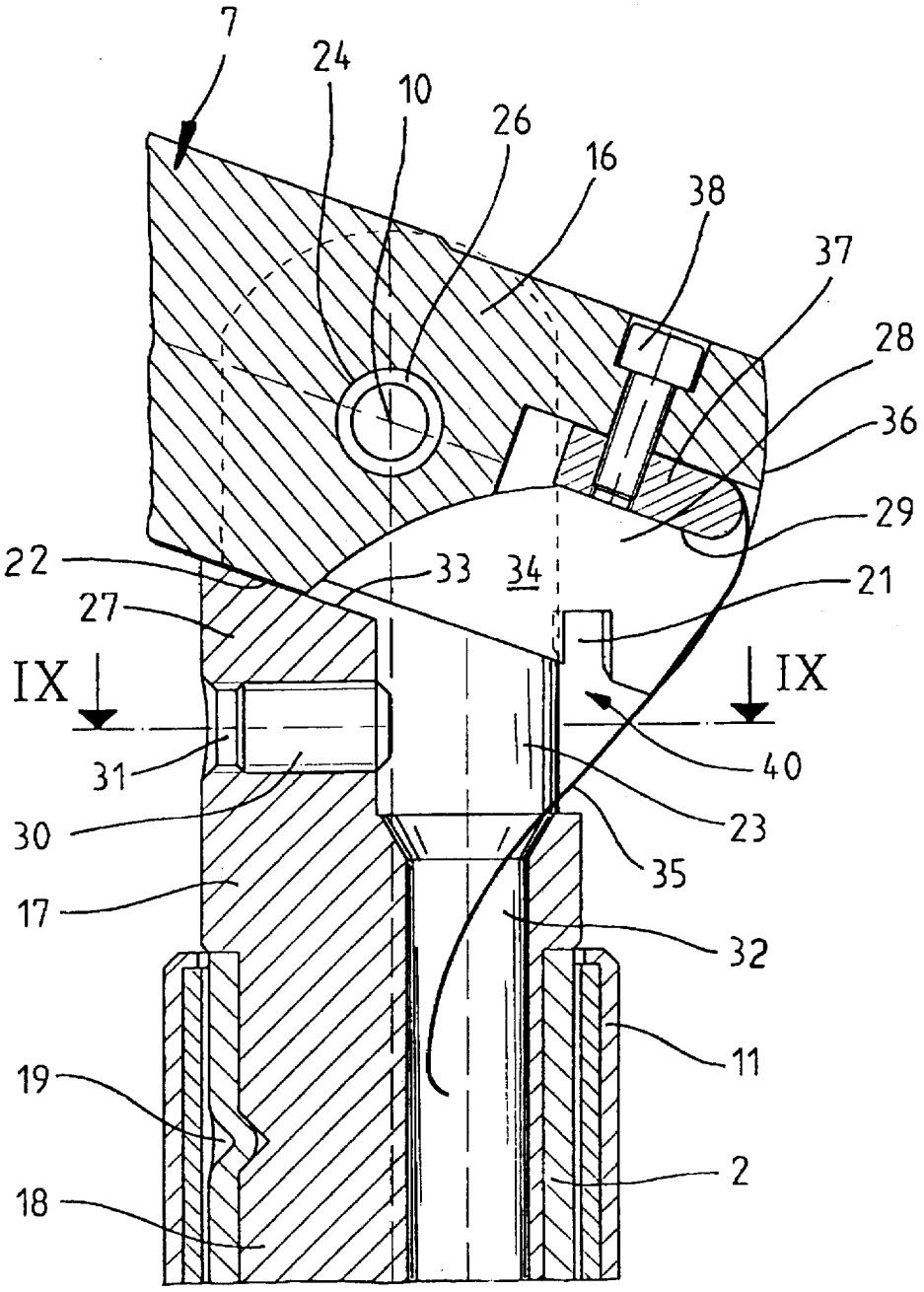
FIG. 7 is a large scale vertical section through the fitting of the umbrella in the storage position with the slide retracted.

To prevent a user from pinching his or her finger between the fitting parts 16 and 17 when moving from the storage position into the deployed position, a leaf spring 35 has one end secured underneath a steel holder block 37 secured by a screw 38 to the part 16 and another end projecting down in a bore 32 extending axially along the part 17. Thus when the latch slide 11 is held in the down position as indicated in FIG. 7 this spring 15 covers the gap 40 between the parts 16 and 17, preventing anything from getting in, and when the slide 11 is released so it pops up and fits in the notch 21, the spring 35 still shields and covers the remaining gap, only leaving a lower end surface 36 of the part 16 exposed. In the deployed position the spring 35 extends straight down in the passage 32, and in fact the spring 35 urges the parts 16 and 17 into the storage position so that, when the slide 11 is pulled down they will normally naturally spring into this position.

I claim:

1. An umbrella comprising:

a foldable canopy;

an elongated boom having an end;

a joint at the end connected to the canopy and suspending the canopy from the boom end;

an upright mast having an upper end;

a fitting having a lower part fixed in the upper mast end, an upper part slidably receiving the boom, and a pivot interconnecting the upper and lower parts for pivoting of the upper part on the lower part about a horizontal axis between a deployed position with the boom extending transversely of the mast and a storage position with the boom extending generally parallel to the mast; and means including a slide longitudinally displaceable on the mast between a lower position freeing the upper part for pivoting between its storage and deployed positions and an upper position engaging the upper part in both the storage and deployed positions and positively retaining the upper part therein.

2. The umbrella defined in claim 1, further comprising a spring braced between the mast and the slide and urging the slide into the upper position.

3. The umbrella defined in claim 1 wherein the slide is tubular and surrounds the mast and lower fitting part, the upper fitting part having a lower portion fitting complementarily into the slide in the upper position thereof.

4. The umbrella defined in claim 1 wherein the parts are provided with respective abutment surfaces one of which is adjustable and that engage each other only in the deployed position.

5. The umbrella defined in claim 1 wherein the upper part is formed with a downwardly and laterally open cutout in which the respective abutment surface is formed and the lower part is formed with an upwardly projecting portion in which the respective abutment surface is formed and which projects upward into the cutout in the deployed position.

6. The umbrella defined in claim 5 wherein the portion of the lower part is provided with a screw extending generally perpendicular to a longitudinal axis of the mast and forming the respective abutment surface, whereby the screw can be driven in and out to move the respective abutment surface.

7. The umbrella defined in claim 5 wherein the upper part and the portion of the lower part have abutment surfaces that mutually engage each other only in the storage position.

8. The umbrella defined in claim 1 wherein the upper part is formed with a notch into which an upper end of the slide fits in the upper position of the slide and storage position of the upper part.

9. The umbrella defined in claim 8 wherein the upper and lower parts have abutment surfaces that mutually engage each other only in the storage position.

10. The umbrella defined in claim 9 wherein the abutment surfaces are to one side of a longitudinal axis of the mast.

11. The umbrella defined in claim 1 wherein one of the parts has a pair of spaced cheeks extending toward the other part and the other part has a web fitted between the cheeks, the pivot being a pin extending through the cheeks and web along an axis substantially perpendicular to a longitudinal axis of the mast.

12. The umbrella defined in claim 11 wherein the pin is seated in the cheeks and carries a bushing engaging the web.

13. The umbrella defined in claim 11 wherein the webs are formed on the upper part, the webs being formed with a notch into which an upper end of the slide fits in the upper position of the slide and storage position of the upper part.

14. The umbrella defined in claim 11 wherein the one part is the upper part and the upper part is provided with a leaf spring projecting down into the lower part.

15. The umbrella defined in claim 14 wherein the lower part is formed with a longitudinally extending and upwardly open passage receiving the leaf spring.

16. The umbrella defined in claim 15 wherein the upper part has a block under which an end of the spring is secured.

* * * * *